US008881426B1

(12) United States Patent
Elze

(10) Patent No.: US 8,881,426 B1
(45) Date of Patent: Nov. 11, 2014

(54) DEVICE FOR ADORNING A SANDAL STRAP

(71) Applicant: Helmut Richard Elze, Lafayette, CA (US)

(72) Inventor: Helmut Richard Elze, Lafayette, CA (US)

( * ) Notice: Subject to any disclaimer, the term of this patent is extended or adjusted under 35 U.S.C. 154(b) by 208 days.

(21) Appl. No.: 13/674,449

(22) Filed: Nov. 12, 2012

(51) Int. Cl.
*A43B 23/24* (2006.01)

(52) U.S. Cl.
CPC ..... *A43B 23/24* (2013.01)
USPC ..... 36/11.5; 36/136

(58) Field of Classification Search
USPC ..... 36/11.5, 136
See application file for complete search history.

(56) References Cited

U.S. PATENT DOCUMENTS 6,769,204 B1 * 8/2004 Phillips ..... 36/136
7,891,117 B2 * 2/2011 Sack ..... 36/11.5
2004/0093765 A1 * 5/2004 Baldwin ..... 36/101
2006/0048408 A1 * 3/2006 Spann ..... 36/11.5
2008/0028636 A1 * 2/2008 Lusk ..... 36/11.5
2010/0058619 A1 * 3/2010 Ferrante et al. ..... 36/136
2010/0275464 A1 * 11/2010 Mian ..... 36/136
2011/0225851 A1 * 9/2011 Nelson ..... 36/136
2012/0186109 A1 * 7/2012 Vanderbeek ..... 36/136
2012/0234042 A1 * 9/2012 Chase et al. ..... 63/1.18
2013/0086820 A1 * 4/2013 Lura et al. ..... 36/136
2013/0091620 A1 * 4/2013 Randolph ..... 2/244

* cited by examiner

*Primary Examiner* — Marie Bays

(57) ABSTRACT

A device for adorning a sandal strap provides an easy way for a user to adorn a sandal. The device comprises an adornment strap mechanically coupled to the sandal strap. The sandal strap is comprises with a first sandal strap hole, a second sandal strap hole and a groove. The adornment strap further comprises a first clamp bracket and a second clamp bracket. The first clamp bracket can fit through the first sandal strap hole. The second clamp bracket can fit through the second sandal strap hole. The adornment strap can rest in the groove. The adornment strap is mechanically coupled to a band attachment bracket. The band attachment bracket enables the user to hand a charm from the adornment strap. In this manner the user can easily adorn the sandal.

3 Claims, 4 Drawing Sheets

DEVICE FOR ADORNING A SANDAL STRAP

FIELD OF THE INVENTION

This invention relates to devices that can adorn open-toed footwear.

BACKGROUND OF THE INVENTION

Flip-flops (also called zōri, thongs, jandals, or a variety of other names throughout the world) are a type of open-toed sandal typically worn in casual situations, such as outside or at the beach. They consist of a flat sole held loosely on the foot by a Y-shaped strap (herein called a "sandal strap") that passes between the first and second toes and around either side of the foot. They may also be held to the foot with a single strap over the front of the foot rather than a thong.

Prior to the disclosed invention there was no consistent theory for adorning a flip-flop in a replaceable manner. The prior art includes: U.S. Patent Application 2012/0186109 filed by Vanderbeek; U.S. Patent Application 2010/0058619 filed by Ferrante; and U.S. Pat. No. 7,200,959 issued to Spann.

Vanderbeak teaches an interchangeable decorative strand for use in a flip flop that is affixed to the sandal as a sandal strap, but is not attached to an existing sandal strap. Ferrante teaches a method for attaching ornaments to a sandal strap where the ornaments are filled with a fluid, but does not teach an attachment to an existing sandal strap. Spann teaches a thong attached to a sandal where ornaments can be attached to the sandal strap. Like Ferrante, Spann teaches adorning the sandal strap and not a device attached to the sandal strap. One advantage of the present invention over the prior art is the ability to easily change adornments to the sandal without having to replace the sandal strap.

BRIEF SUMMARY OF THE INVENTION

A device for adorning a sandal strap provides an easy way for a user to adorn a sandal. The device comprises an adornment strap mechanically coupled to the sandal strap. The sandal strap is comprises with a first sandal strap hole, a second sandal strap hole and a groove. The adornment strap further comprises a first clamp bracket and a second clamp bracket. The first clamp bracket can fit through the first sandal strap hole. The second clamp bracket can fit through the second sandal strap hole. The adornment strap can rest in the groove. The adornment strap is mechanically coupled to a band attachment bracket. The band attachment bracket enables the user to hand a charm from the adornment strap. In this manner the user can easily adorn the sandal.

BRIEF DESCRIPTION OF THE SEVERAL VIEWS OF THE DRAWINGS

Figure 1:
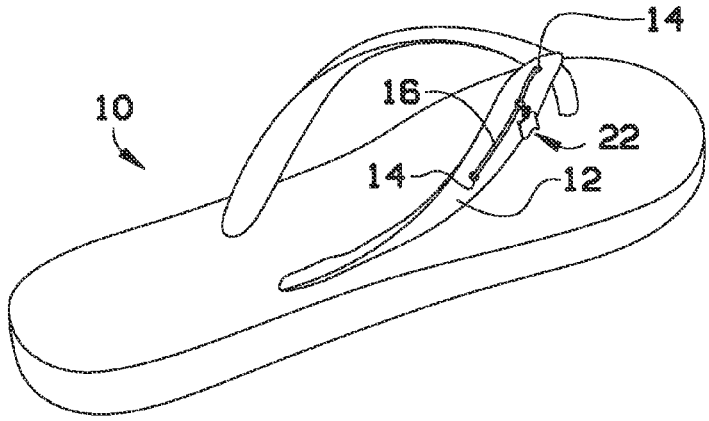

Having thus described the invention in general terms, reference will now be made to the accompanying drawings, which are not necessarily drawn to scale, and wherein:

FIG. 1 is a perspective view of the invention shown in use.

Figure 2:
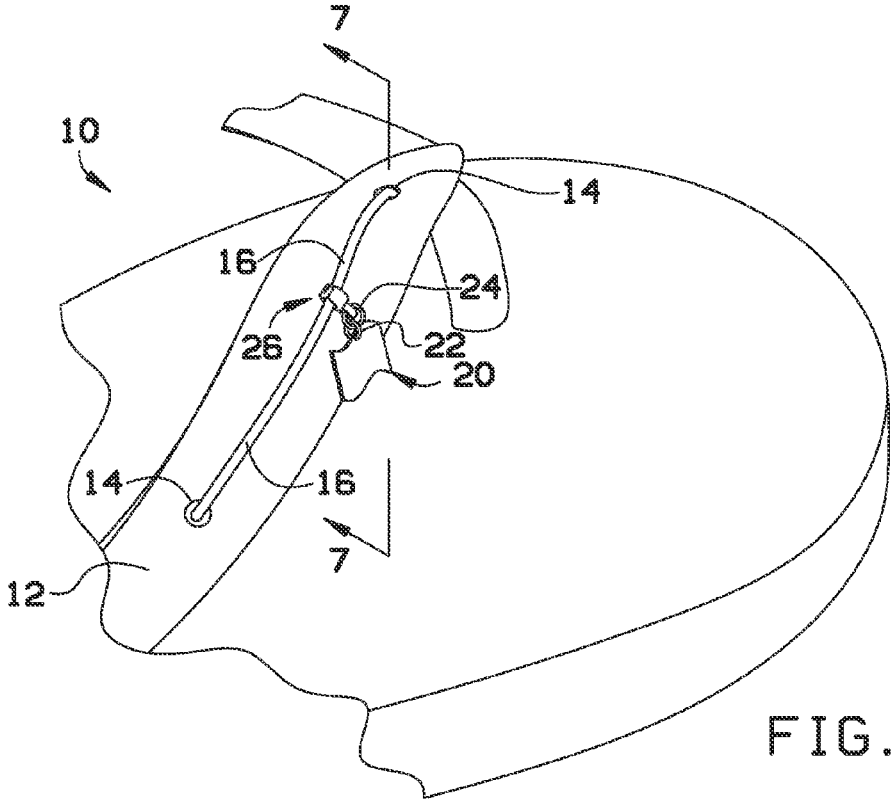

FIG. 2 is a detail perspective view of the invention shown in use.

Figure 3:
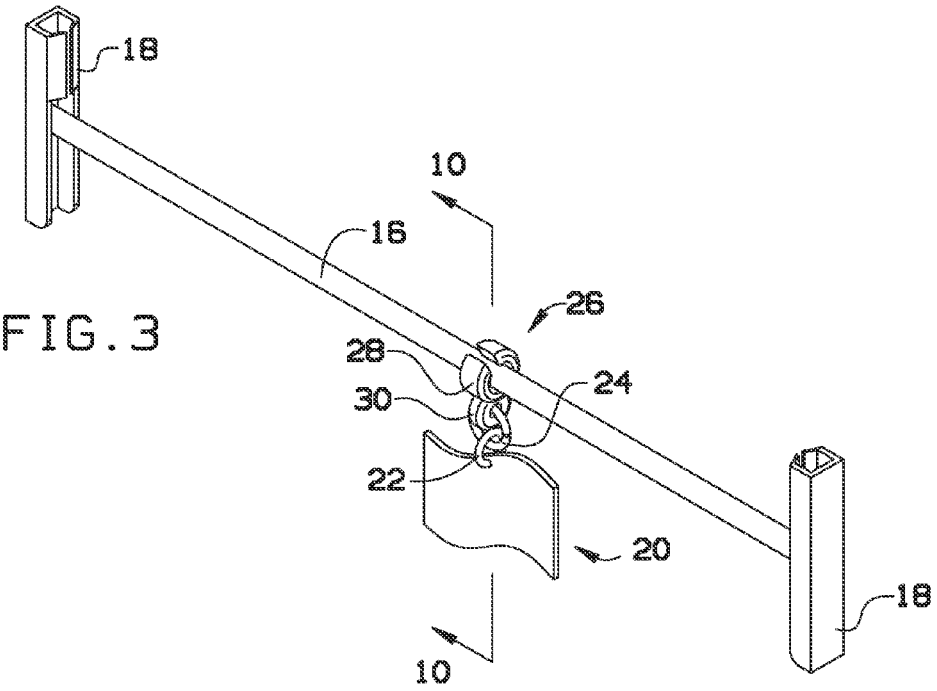

FIG. 3 is a perspective view of the invention.

Figure 4:
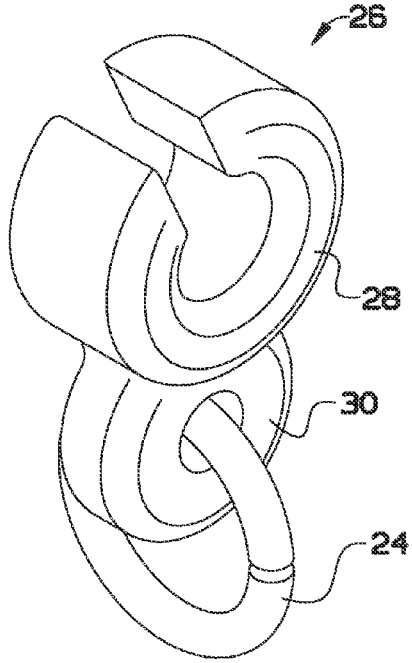

FIG. 4 is a perspective view of the band attachment bracket and mid-ring only.

Figure 5:
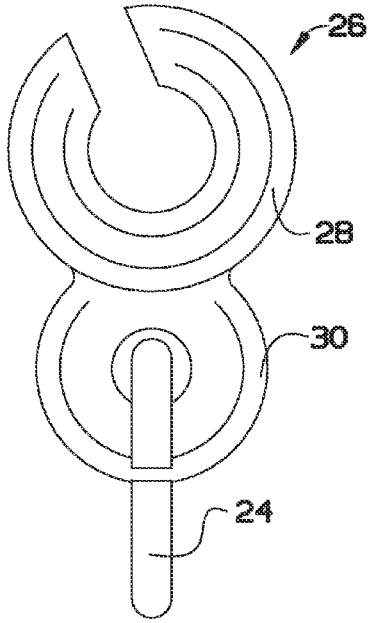

FIG. 5 is a side view of the band attachment bracket and mid-ring only.

Figure 6:
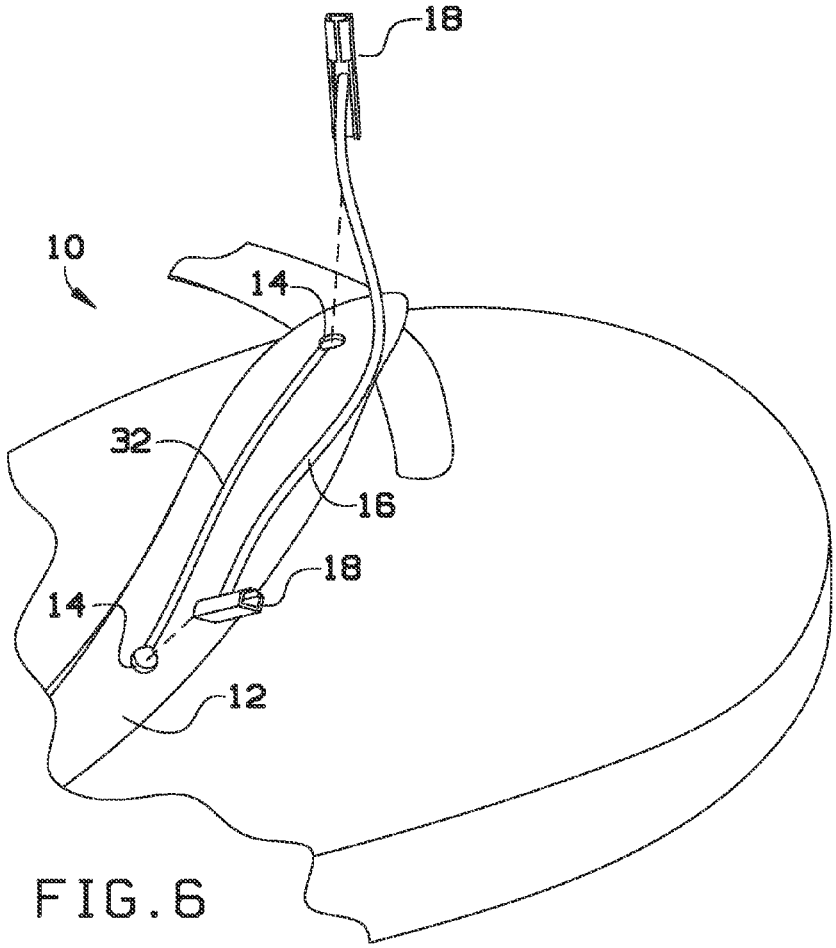

FIG. 6 is an exploded detail view of the invention illustrating securement of the elastic band and associated components to the sandal strap.

Figure 7:
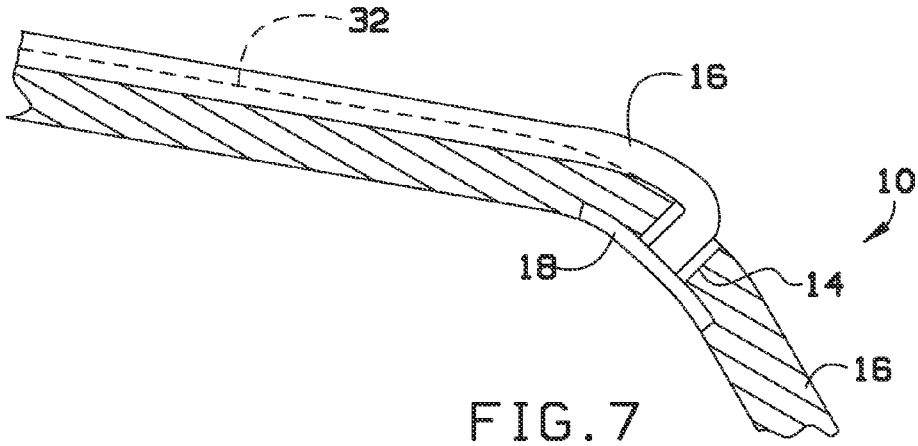

FIG. 7 is a section detail view of the invention along line 7-7 in FIG. 2.

Figure 8:
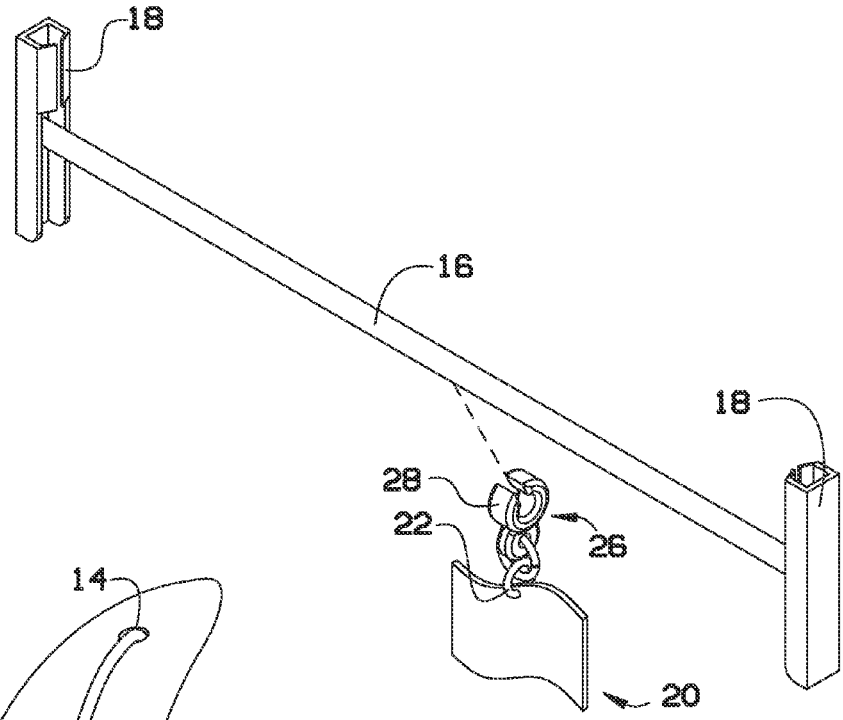

FIG. 8 is an exploded view of the invention illustrating securement of the band attachment bracket onto the elastic band but not illustrating the sandal strap.

Figure 9:
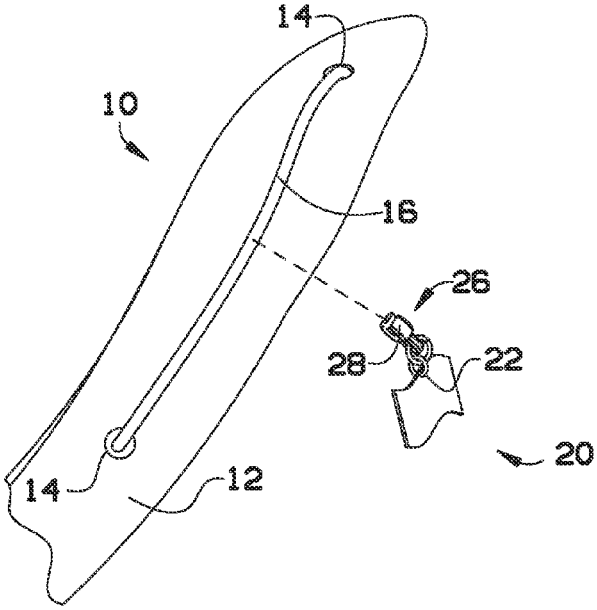

FIG. 9 is an exploded view of the invention illustrating securement of the band attachment bracket onto the elastic band and illustrating the sandal strap.

Figure 10:
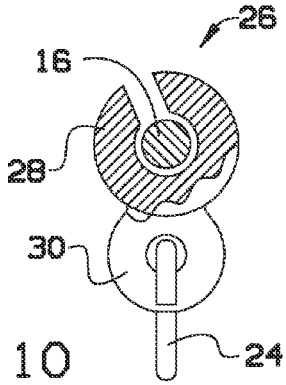

FIG. 10 is a section detail view along line 10-10 in FIG. 3.

DETAILED DESCRIPTION OF THE INVENTION

Embodiments of the present invention overcome many of the obstacles associated with adorning a sandal, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1, FIG. 2, FIG. 6 and FIG. 7 show the sandal adornment in use. Sandal 10 is mechanically coupled to sandal strap 12 in a manner well known to the prior art. Sandal strap 12 is perforated with a first sandal strap hole 14 and a second sandal strap hole 14. Adornment strap 16 is mechanically coupled to a first clamp bracket 18 and a second clamp bracket 18. A user can easily insert first clamp bracket 18 into first strap hole 14 and second clamp bracket 18 into first strap hole 14. Groove 32 connects first strap hole 14 and second strap hole 14. Once adornment strap 16 is inserted into sandal strap 12 along groove 32, a user can adorn sandal strap 12 as shown in FIG. 3, FIG. 4, FIG. 5, FIG. 8, FIG. 9 and FIG. 10.

FIG. 3, FIG. 4, FIG. 5, FIG. 8, FIG. 9 and FIG. 10 show how to adorn sandal strap 12. A user can slide band attachment bracket 26 onto adornment strap 16. Band attachment bracket 26 comprises band attachment bracket band ring 28 mechanically coupled to band attachment bracket mid-ring ring 30. Band attachment bracket mid-ring ring 30 is mechanically coupled to mid-ring 24. Mid-ring 24 is mechanically coupled to charm ring 22. Charm ring 22 is mechanically coupled to charm 20.

Notably, band attachment bracket band ring 28 can be circular in shape, but should have a missing portion which is slightly more narrow than the diameter of adornment strap 16, this allows a user to slide band attachment bracket band ring 28 over adornment strap 16 that can slightly shrink to fit and then expand such as to avoid being removed from adornment strap 16 without intervention by a user. Mid-ring 24 can be circular in shape, but should have a portion missing, mid-ring 24 can be pulled apart by a user to accommodate charm ring 22 and then compressed again to allow a user to secure charm ring 22 to mid-ring 24.

In this manner, a user can adorn a sandal strap in the following manner, a user can change adornment strap 16 for an adornment strap 16 in the color and thickness of one's choosing. A user can have as many band attachment brackets 26 as desired. A user can change charm 20 on each band attachment bracket 26 as desired.

While the invention can be made from a wide variety of known materials in known manners, the following construction can be effective. Adornment strap 16 needs to be cut into an appropriate length for each application and be attached to the item of clothing or accessory item in a method that is fitting for the specific item that it is being attached to. This may include a metal or plastic butterfly crimp attached to the ends or magnetic metal parts or snaps as clamp brackets 18. Band attachment bracket 26 which attaches to adornment band 16 can be produced by making a mold which is then used to form the component out of a metal alloy or plastic material.

Of course this technology is not limited to an easy way for users to adorn a sandal and can be applied to attaching tools to a belt; attaching camping or outdoor gear such as a water bottle to a backpack; and attaching keys or a key ring to an item such as a backpack, luggage or clothing.

That which is claimed:

1. A device for adorning a sandal strap provides an easy way for a user to adorn a sandal, the device comprising, an adornment strap mechanically coupled to the sandal strap, where the sandal strap is comprises with a first sandal strap hole, a second sandal strap hole and a groove;

the adornment strap further comprises a first clamp bracket and a second clamp bracket, such that the first clamp bracket can fit through the first sandal strap hole; the second clamp bracket can fit through the second sandal strap hole; and the adornment strap can rest in the groove;

the adornment strap is mechanically coupled to a band attachment bracket; where the band attachment bracket enables the user to hang a charm from the adornment strap; in this manner the user can easily adorn the sandal.

2. The device of claim 1, further comprising, the band attachment bracket further comprises a band attachment bracket band ring mechanically coupled to band attachment bracket mid-ring ring; the band attachment bracket mid-ring ring is mechanically coupled to a mid-ring; such that the mid-ring is mechanically coupled to a charm ring and the charm ring is mechanically coupled to the charm;

in this manner, the user can change the adornment strap for the adornment strap in a color and thickness of one's choosing; the user can have as many band attachment brackets as desired; and the user can change the charm on each band attachment bracket as desired.

3. The device of claim 1, further comprising, the band attachment bracket further comprises a band attachment bracket band ring mechanically coupled to band attachment bracket mid-ring ring; the band attachment bracket mid-ring ring is mechanically coupled to a mid-ring; such that the mid-ring is mechanically coupled to a charm ring and the charm ring is mechanically coupled to the charm;

the band attachment bracket band ring is circular in shape with a missing portion; where the missing portion is slightly more narrow than a diameter of the adornment strap; this allows the user to slide the band attachment bracket band ring over the adornment strap; where the adornment strap can slightly shrink to fit and then expand such as to avoid being removed from the adornment strap without intervention by the user; the mid-ring can be circular in shape with a portion missing, such that the mid-ring can be pulled apart by the user to accommodate the charm ring and then compressed again to allow the user to the secure the charm ring to the mid-ring;

in this manner, the user can change the adornment strap for the adornment strap in a color and thickness of one's choosing; the user can have as many band attachment brackets as desired; and the user can change the charm on each band attachment bracket as desired.

* * * * *